US005307251A

United States Patent [19]

Shaffer

[11] Patent Number: 5,307,251

[45] Date of Patent: Apr. 26, 1994

[54] PEDESTRIAN CROSSING SAFETY DEVICE

[76] Inventor: Terry L. Shaffer, 1230 N. Montgomery County Line Rd., Tipp City, Ohio 45371

[21] Appl. No.: 969,719

[22] Filed: Oct. 30, 1992

[51] Int. Cl.[5] ..... A63B 15/02

[52] U.S. Cl. ..... 362/102; 362/84; 362/158; 362/186; 40/542

[58] Field of Search ..... 362/102, 158, 84, 185, 362/186, 203, 205, 191, 195, 310; 40/542, 586

[56] References Cited

U.S. PATENT DOCUMENTS

| | | | |
|---|---|---|---|
| D. 274,561 | 7/1984 | Stansbury, Jr. | D26/49 |
| D. 297,170 | 8/1988 | Elliott | D26/24 |
| D. 324,186 | 2/1992 | DeFazio | D10/114 |
| 1,066,540 | 7/1913 | Smithwick | 362/102 |
| 2,259,443 | 10/1941 | Geier | 362/102 |
| 2,271,190 | 1/1942 | Giaimo | 362/102 |
| 2,358,867 | 9/1944 | Madan | 362/84 |
| 2,642,519 | 6/1953 | Caustin et al. | 362/102 |
| 2,681,979 | 6/1954 | Manoloff | 362/102 |
| 2,905,863 | 9/1959 | Martin et al. | 362/84 |
| 3,796,869 | 3/1974 | Stone | 362/84 |
| 3,917,264 | 11/1975 | Davidson et al. | 362/84 |
| 4,530,039 | 7/1985 | Shin-shi | 362/158 |
| 4,543,905 | 10/1985 | McKenney | 116/63 |
| 4,574,726 | 3/1986 | Sullivan | 116/28 |
| 4,616,225 | 10/1986 | Woudenberg | 340/908 |
| 5,006,971 | 4/1991 | Jenkins | 362/252 |
| 5,023,607 | 6/1991 | Staten | 340/908 |
| 5,036,442 | 7/1991 | Brown | 362/102 |
| 5,103,388 | 4/1992 | Mayhew | 362/186 |
| 5,109,322 | 4/1992 | Loughlin | 362/109 |

FOREIGN PATENT DOCUMENTS

| | | | |
|---|---|---|---|
| 20214 | of 1900 | United Kingdom | 362/102 |
| 2089015 | 6/1982 | United Kingdom | 362/158 |

OTHER PUBLICATIONS

Advertisement for an emergency strobe light.

*Primary Examiner*—Ira J. Lazarus
*Assistant Examiner*—Y. Quach
*Attorney, Agent, or Firm*—R. William Graham

[57] ABSTRACT

The present invention provides a relatively lightweight elongated staff having a particularly well arranged strobe light and sign which provides an enhanced warning while maximizing its ease of transportability for the carrier and use.

3 Claims, 1 Drawing Sheet

PEDESTRIAN CROSSING SAFETY DEVICE

BACKGROUND OF THE INVENTION

1. Field of the Invention

The field of the invention relates to signaling device, and more particularly to a new and improved pedestrian crossing safety apparatus wherein the same is arranged for directing attention to arrest movement of motor vehicles permitting pedestrians to cross at designated intersections.

2. Description of the Prior Art

At intersections relating to passage of pedestrians, such as school children, crossing guards are frequently at a disadvantage in directing attention to a pedestrian crossing environment. This is particularly the case in inclement weather conditions wherein visibility of a motorist is impaired by darkness, fog, rain, snow, or sleet, which form a continued obstruction in the field of vision.

Presently, crossing guards utilize a simplistic warning device, such as a wooden stick with a fluorescent sign attached thereto. This type of device has found an appreciable market primarily due to the little expense required for production and maintenance of the same. Such a device falls short of providing adequate safety for a pedestrian crossing during dark, rainy, snowy, foggy, sleeting or other conditions which limit or inhibit visibility. This is due such device's limited ability to attract attention to the crossing guard and pedestrian.

An attempt at solving the problem of increasing safety at pedestrian crossings has been to provide a conventional octagonal stop sign mounted to an end of an L-shaped pole, the sign having a plurality of lights disposed about the perimeter thereof and being counter balanced by a weighted base mounted to the other end of the pole. The base includes a battery therein to power the lights. The device is, however, relatively bulky, awkward, and expensive compared to previous devices. As a result, such device is relatively unsuitable for pedestrian crossings where small school children act as crossing guards and require a warning device which is relatively lightweight and easily carried for extended periods. Thus, this apparatus has apparently met with little commercial success.

Therefore, it is appreciated that there continues to be a need for a new and improved pedestrian crossing signal device as set forth by the present invention which addresses the problems of ease and use, and cost of manufacturing while maximizing the visible warning zone. The present invention substantially solves these problems.

SUMMARY OF THE INVENTION

In view of the above disadvantages of the known types of pedestrian crossing signal devices, the present invention attempts to overcome deficiencies of the prior art by providing a relatively lightweight elongated staff having a particularly well arranged strobe light and sign which provides an enhanced warning while maximizing its ease of transportability for the carrier and use in directing attention to a pedestrian crossing environment, all of which is done in a relatively inexpensive manner. The device is particularly well suited for carrying over extended periods of time due to its relatively light weight nature. The general purpose of the present invention is to provide a unique and improved pedestrian crossing safety device which includes all the advantages of the prior pedestrian crossing signal apparatus and overcomes the disadvantages thereof.

The pedestrian crossing safety device of the present invention includes a relatively lightweight elongated tubular member. At one end of the member, an inner surface defines an opening which is shaped to fitably receive a battery therein. Adjacent the inner surface to which the battery is positioned are conducting elements for contacting oppositely charged ends of the battery. A switch interconnects conducting the elements and allows current to flow therethrough. Strobe light means for emitting a relatively intense wavelength of light are positionable within the opening of the inner end to contact one of the conducting elements such that a strobe light element thereof protrudes beyond the end of the tubular member to emit light in generally all directions as opposed to a beam of light. Means are provided for sealing about the strobe light means and the end of the tubular member to prevent water and debris from passing therebetween.

In the preferred embodiment, the tubular member is provided with a fluorescent coloring to further bring its attention to an oncoming motor vehicle operator. In addition, a lightweight flexible sheet-like fluorescent colored pedestrian sign is provided which is slidably connectable to the tubular member in a fashion to be substantially fully extended and remain in a visually upright position during the transporting thereof.

It is therefore an object of the present invention to provide a new and improved pedestrian crossing safety device which has all the advantages of the prior signal device and none of the disadvantages.

It is a further object of the present invention to provide a new and improved pedestrian crossing safety device which is of a durable and reliable construction.

It is another object of the present invention to provide a new and improved pedestrian crossing safety device which may be readily and cost efficiently manufactured and marketed with regard to both materials and labor making such pedestrian crossing safety device economically available to the buying public.

Still another object of the present invention is to provide a new and improved pedestrian crossing safety device which may be compactly stored when not being utilized.

Yet another object of the present invention is to provide a new and improved pedestrian crossing safety device wherein the same provides a relatively lightweight elongated structure having a particularly arranged strobe light and sign for guiding pedestrians in a crossing environment.

These together with other objects of the invention, along with various features of novelty which characterize the invention, are pointed out with particularity in the claims annexed to and forming a part of this disclosure.

For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
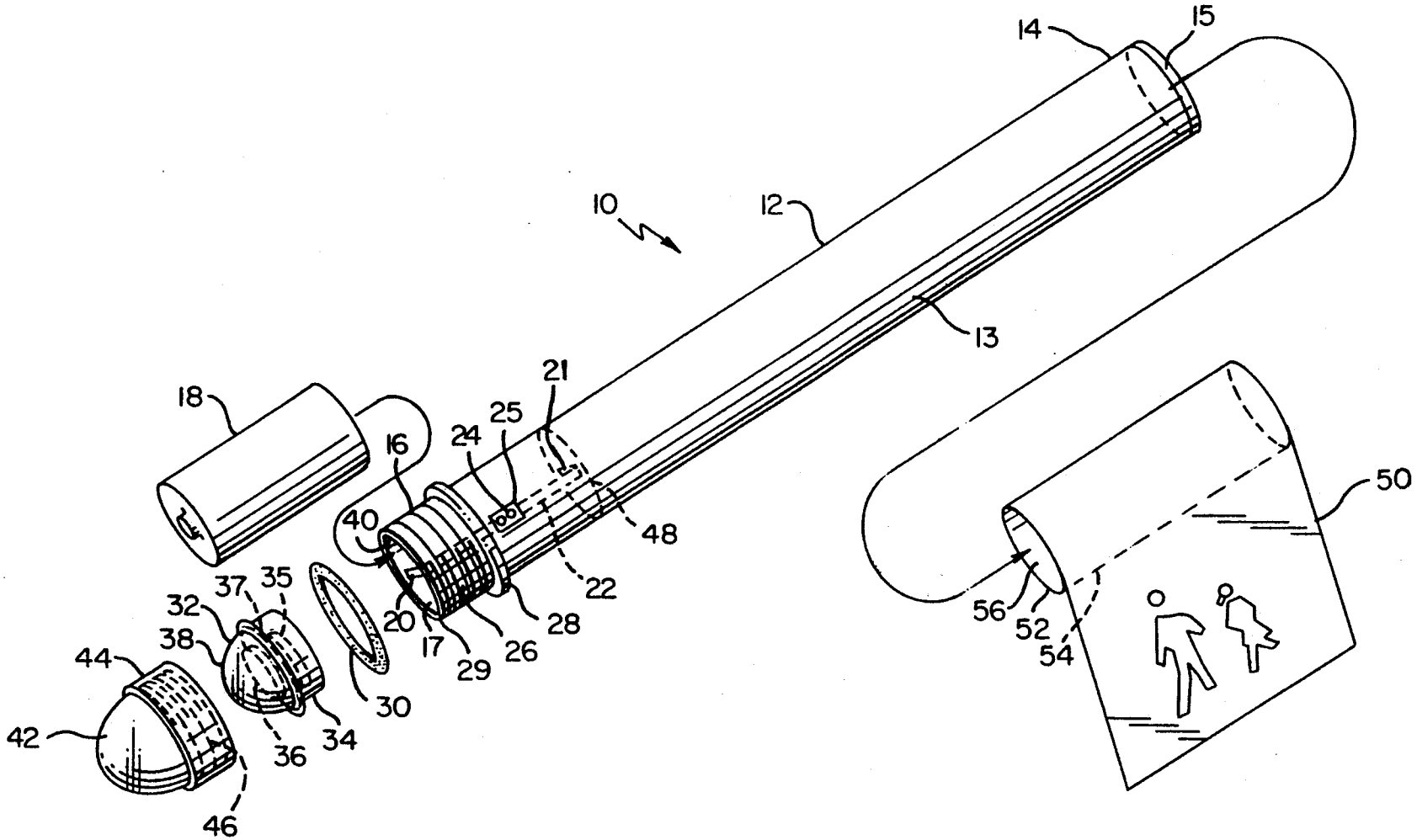
FIG. 1 is an exploded perspective view of the present invention.

With reference to FIG. 1, a new and improved pedestrian crossing safety device embodying the principles and concepts of the present invention is generally designated by the reference numeral 10. More specifically, the pedestrian crossing safety device of the present invention includes a lighweight elongated tubular member 12. The member 12 must be of a sufficient length and thickness to act not only in aiding effectiveness of warning on coming traffic, but also in providing a bar to adjacent pedestrians who wish to pass such crossing. In this regard, the member 12 should preferably be made of a material which is rigid, durable and lightweight, such as polyvinyl chloride or other plastic material, for example, and be of a length ranging from approximately three to four and one half feet. It should be noted that the construction and length are provided to fulfill the requirements of the specification, but are not intended to be all inclusive and it should be recognized that modifications thereof will be readily apparent to those skilled in the art. The outer surface 13 of the member 12 is preferably fluorescent colored to further aid in catching the attention of approaching motor vehicle operators. At one end 14 of the member 12, a support base 15 is sealably attached thereto.

At the other end 16 of the member 12 is an inner surface 17 which is shaped to fitably receive a battery 18 therein. Adjacent the inner surface 17 to which the battery 18 is positioned is conducting element 21 for contacting the charge end of the battery 18 in a conventional manner. Integrally formed in the end 16 is a switch 24 between the elements 20 and 21 to selectively cause a current to flow therethrough. The switch 24 is provided with a seal 25 to prevent water or debris from passing thereby into the tubular member 12.

About the end 16 is a threaded portion 26 and a radially extending collar 28, wherein the collar 28 is axially spaced from a terminating portion 29 of the end 16 with the threaded portion 26 lying therebetween. An o-ring seal 30 is provided which is of a size to be readily received about the end 16 and positioned adjacent the collar 28. Strobe light means 32 includes a conducting portion 34, intermittent power control unit 35 is operatively connected to the conducting portion 34, high intensity strobe element 36 is operatively connected to the unit 35, and reflective backing 37 is positioned between the element 36 and both the conducting portion 34 and unit 35, with a hemispherical cover 38 about the element 36 and adjacent backing 37, for emitting a relatively intense wavelength of light when strobe light means 32 is operatively positioned within an opening 40 of the inner end 16 with the battery 18 therein. When assembled, conducting portion 34 contacts conducting element 20 to form a circuit with the strobe light element 36, with element 36 and cover 38 protruding beyond the terminating portion 29 of the end 16. The strobe light element 36 preferably includes a xenon module to effect a relatively high intense and brilliant emission of light. However, other luminescence elements are employable in the present invention.

An external hemispherical cover 42 is provided which includes an end 44. Within the end 44 is a threaded surface 46 which is complementary formed to receive the threaded surface 26 therein with the end 44 abutting o-ring 30 when connected to the member 12. The hemispherical covers 38 and 42 are substantially translucent and together with the reflective backing 37 provide an effect of which 360° light emission upon the electrical charging of the strobe light element 36. However, it may be desirable to use a tinted or colored cover in combination with the present invention.

In assembling the device 10, the battery 18 is disposed in the opening 40 such that the operative terminal end of the battery 18 contacts the element 36 as is apparent from the drawing. O-ring 30, strobe light means 32 and cover 42 are then assembled together in a manner apparent from the drawings and description above. When assembled, the cover 42, o-ring 30 and collar 28 provide a substantially water and debris proof seal. An internal cap seal 48 resides in the tubular member 12 axially spaced from the portion 29 and transversely extends across the tubular member 12.

A flexible sheet-like material 50, or sign, is provided for attachment to the tubular member 12. In this regard, the sheet-like material has one end 52 which overlaps and connects to a portion 54 of the material 50 to form an opening 56 of slightly less diameter than the diameter of the tubular member 12. Thus, the sheet-like material 50 is slightly stretchable such that it can be slid over the outer surface 13 of the tubular member 12. It should be readily apparent other means for attaching the sign 50 to the tubular member 12 can be used, such as cement or tape, for example, The sheet-like material 50 is constructed of a substantially water proof material, such as a vinyl material, for example, and is provided with a fluorescent coloration and pedestrian design complementary to that of the outer surface 13 of the tubular member 12. When completely assembled, the device is highly suitable for use in any of the aforementioned weather conditions and provides a new and novel pedestrian crossing safety device.

With respect to the above description, it is to be realized that the optimum dimensional relationship for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to, falling within the scope of the invention.

What is claimed is:

1. A battery powered pedestrian crossing safety device to aid in walking pedestrians across a traffic intersection, comprising:

a light weight elongated tubular member having a first end, a second end, and a surface portion axially spaced from said first end which transversely extends across said tubular member so that said first end forms an inner surface defining shaped to fitably receive a battery therein, wherein said tubular member is of a sufficient length to act as a bar to adjacent pedestrians and wherein said tubular member has a fluorescent outer surface coloring particularly well suited for attracting the attention of an approaching motor vehicle operator;

means for conducting a current from the battery to a high intensity light emitting element, said conducting means connected to said inner surface of said tubular member;

means for switching on and off the current in said conducting means, said switching means sealingly, integrally formed in a portion of said first end of said tubular member;

a light weight sheet-like material slidably connectable to said tubular member having a fluorescent coloration on exposed surfaces thereof, said fluorescent coloration of said sheet-like material being complimentary to said fluorescent coloration of said tubular member; and strobe light means operatively associated with said conducting means for emitting a relatively intense wavelength of light in generally all directions, wherein said strobe light means includes a conducting portion positionable within said first end of said tubular member for contacting said conducting means, an intermittent power control unit operatively connected with said conducting portion, said high intensity light emitting element operatively connected to said intermittent power control unit and extending out from said first end, a reflective backing interposed between said light emitting element and both said conducting portion and said intermittent power control unit such that when said conducting portion and said intermittent power control unit are disposed in said first end of said tubular member said reflective backing extends adjacent a plane formed by an outermost portion of said first end of said tubular member, and a substantially translucent hemispherical cover sealingly connectable to said first end of said tubular member and surrounding said light emitting element and cooperative with said reflective backing to substantially allow for a 360° light emission effect and which serves as a beacon for said device and enhances said fluorescent colored elongated tubular member and said fluorescent colored sheet-like material, the combination thereof providing for said pedestrian safety crossing device.

2. A battery powered pedestrian crossing safety device to aid in walking pedestrians across a traffic intersection, comprising:

a light weight elongated tubular member having a first end, a second end, and an inner surface defining a chamber shaped to fitably receive a battery therein, wherein said tubular member is of a sufficient length to act as a bar to adjacent pedestrians and wherein said tubular member has a fluorescent outer surface coloring particularly well suited for attracting the attention of an approaching motor vehicle operator;

means for conducting a current from the battery to a high intensity light emitting element, said conducting means connected to said inner surface of said tubular member;

means for switching on and off the current in said conducting means, said switching means sealingly, integrally formed in a portion of said first end of said tubular member;

a light weight sheet-like material slidably connectable to said tubular member having a fluorescent coloration on exposed surfaces thereof, said fluorescent coloration of said sheet-like material being complimentary to said fluorescent coloration of said tubular member; and strobe light means operatively associated with said conducting means for emitting a relatively intense wavelength of light in generally all directions, wherein said strobe light means includes a conducting portion positionable within said first end of said tubular member for contacting said conducting means, an intermittent power control unit operatively connected with said conducting portion, said high intensity light emitting element operatively connected to said intermittent power control unit and extending out from said first end, a reflective backing interposed between said light emitting element and both said conducting portion and said intermittent power control unit such that when said conducting portion and said intermittent power control unit are disposed in said first end of said tubular member said reflective backing extends adjacent a plane formed by an outermost portion of said first end of said tubular member, and a substantially translucent hemispherical cover sealingly connectable to said first end of said tubular member and surrounding said light emitting element and cooperative with said reflective backing to substantially allow for a 360° light emission effect and which serves as a beacon for said device and enhances said fluorescent colored elongated tubular member and said fluorescent colored sheet-like material, the combination thereof providing for said pedestrian safety crossing device.

3. A battery powered pedestrian crossing safety device to aid in waling pedestrians across a traffic intersection, comprising:

a generally cylindrical light weight elongated tubular member having an inner surface defining a chamber shaped to fitably receive a battery therein, wherein said tubular member is of a sufficient length to act as a bar to adjacent pedestrians and wherein said tubular member has a fluorescent outer surface coloring particularly well suited for attracting the attention of an approaching motor vehicle operator, said tubular member to receive about an outer surface thereof a light weight sheet-like material slidably connectable to said tubular member having a fluorescent coloration on exposed surfaces thereof and being complimentary to said fluorescent coloration of said tubular member;

means for conducting a current from the battery to a high intensity light emitting element, said conducting means connected to said inner surface of said tubular member;

means for switching on and off the current in said conducting means, said switching means formed in a portion of said tubular member; and strobe light means operatively associated with said conducting means for emitting a relatively intense wavelength of light in generally all directions, wherein said strobe light means includes a conducting portion positionable within said tubular member for contacting said conducting means, an intermittent power control unit operatively connected with said conducting portion, said high intensity light emitting element operatively connected to said intermittent power control unit and extending out from an end of said tubular member, a reflective backing interposed between said light emitting element and both said conducting portion and said intermittent power control unit such that when said conducting portion and said intermittent power control unit are disposed in said end of said tubular member said reflective backing extends adjacent a plane formed by an outermost portion of said end of said tubular member, and a substantially translucent hemispherical cover sealingly connectable to said end of said tubular member and surrounding said light emitting element and cooperative with said reflective backing to substantially allow for a 360° light emission effect and which serves as a beacon for said device and enhances said fluorescent colored elongated tubular member and said fluorescent colored sheet-like material, the combination thereof providing for said pedestrian safety crossing device.

* * * * *